United States Patent [19]

Tanae et al.

[11] 4,164,836

[45] Aug. 21, 1979

[54] BULKY YARN PRODUCING APPARATUS

[75] Inventors: Fumio Tanae, Iyo; Hirokazu Matsuoka, Matsuyama, both of Japan

[73] Assignee: Teijin Seiki Company Limited, Osaka, Japan

[21] Appl. No.: 911,220

[22] Filed: May 31, 1978

[30] Foreign Application Priority Data

Jun. 9, 1977 [JP] Japan ..... 52/68174
May 18, 1978 [JP] Japan ..... 53/59357

[51] Int. Cl.[2] ..... D02G 1/02; D02G 3/00; D02G 3/34

[52] U.S. Cl. ..... 57/2; 57/284; 57/289; 57/339; 57/350

[58] Field of Search ..... 57/2, 74 HS, 77.45, 57/77.4, 157 TS

[56] References Cited

U.S. PATENT DOCUMENTS

| | | | |
|---|---|---|---|
| 2,781,555 | 2/1957 | MacHenry | 57/2 X |
| 3,001,358 | 9/1961 | Mayner | 57/2 X |
| 3,007,298 | 11/1961 | Williams et al. | 57/2 X |
| 3,043,088 | 7/1962 | Breen | 57/2 X |
| 3,645,080 | 2/1972 | Yamagata et al. | 57/2 X |
| 3,831,360 | 8/1974 | Horvath | 57/2 |
| 3,946,548 | 3/1976 | Hino et al. | 57/2 X |
| 3,967,441 | 7/1976 | Yasuzuka et al. | 57/2 X |
| 4,062,177 | 12/1977 | Kojima et al. | 57/2 X |
| 4,080,778 | 3/1978 | Adams et al. | 57/2 X |

*Primary Examiner*—John Petrakes
*Attorney, Agent, or Firm*—Cushman, Darby & Cushman

[57] ABSTRACT

Herein disclosed is an apparatus for producing a bulky yarn like natural fibers. The apparatus comprises a twist mechanism provided on a yarn travelling path for twisting and untwisting a yarn; a rubbing mechanism provided on the yarn travelling path of the yarn which is twisted by the twist mechanism and having a rough surface so as to rub filaments constituting the yarn for imparting scratches thereto; and a stretching mechanism provided on the downstream of the rubbing mechanism along the yarn travelling path of the untwisted yarn to stretch the yarn so that the filaments are severed at their scratches to produce a bulky yarn.

7 Claims, 4 Drawing Figures

BULKY YARN PRODUCING APPARATUS

This invention relates to a bulky yarn producing apparatus, and more particularly to an apparatus for producing a fluffy bulky yarn like natural fibers.

There has been produced a wide variety of apparatuses which usually had a false twist spindle or a plurality of false twist discs to impart a false twist to a yarn for obtaining a bulky yarn like natural fibers. However, the obtained bulky yarn was not preferable since it was not sufficiently fluffy as compared with the natural fibers.

It is therefore an object of the present invention to provide a bulky yarn producing apparatus which can produce a sufficiently fluffy bulky yarn like natural fibers by imparting scratches to filaments forming a yarn and then stretching them to be servered and cut at their scratches.

It is another object of the present invention to provide a bulky yarn producing apparatus which can produce a fluffy bulky yarn by entangling a false twisted yarn having filaments scratched by a rubbing mechanism and a usual false twisted yarn.

It is a further object of the present invention to provide a bulky yarn producing apparatus which is simple and compact in construction.

These objects are attained by a bulky yarn producing apparatus of the present invention which comprises a twist mechanism provided on a yarn travelling path for twisting and untwisting a yarn; a rubbing mechanism provided on the yarn travelling path of the yarn which is twisted by the twist mechanism and having a rough surface so as to rub filaments constituting the yarn for imparting scratches thereto; and stretching mechanism provided on the downstream of the rubbing mechanism along the yarn travelling path of the untwisted yarn to stretch the yarn so that the filaments are severed at their scratches to produce a bulky yarn. The stretching mechanism may comprise a pair of first stretcher rollers and a pair of second stretcher rollers provided at the downstream of the first stretcher rollers and spaced apart from the first stretcher rollers along the yarn travelling path to be rotated at a circumferential speed faster than that of the first stretcher rollers for stretching the yarn. The apparatus may further comprise an additional twist mechanism provided on an additional yarn travelling path for twisting and untwisting an additional yarn; and the stretching mechanism may comprise an entangling device collecting the untwisted yarns and having at least one air nozzle ejecting air for diffusing, stretching and entangling yarns to sever the filaments at their scratches. The false twist mechanism may comprise three rotary shafts equi-spacedly arranged in parallel relation with each other, and three friction discs each secured to each of the rotary shafts in such a manner that the friction discs are disposed in partly overlying and axially spaced relation with each other and extend in horizontal planes different from each other; and the rubbing mechanism may be a rubbing disc secured to one of the rotary shafts to be disposed above said friction rollers and formed with the rough surface on its periphery.

The above and other objects, features and advantages of the present invention will become clear from the following particular description of the invention and the appended claims, taken in conjunction with the accompanying drawings which show by way of example a preferred embodiment of the present invention.

Figure 1:
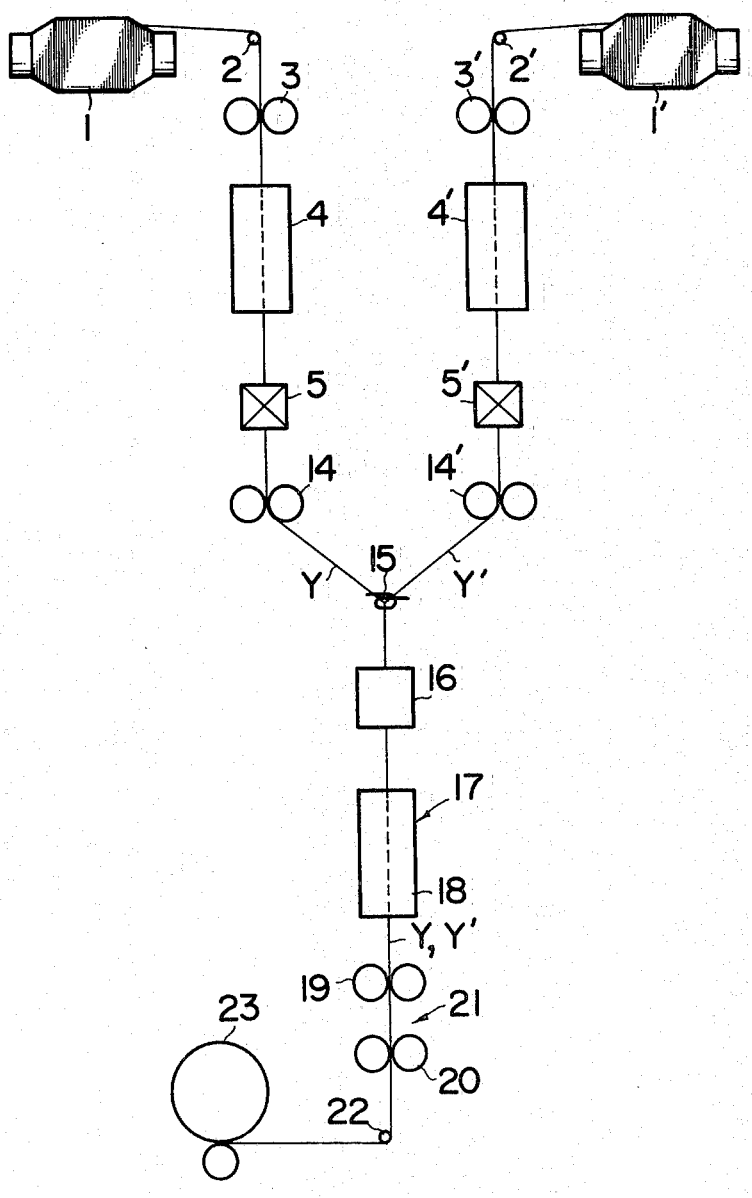
FIG. 1 is a schematic view of a bulky yarn producing apparatus embodying the present invention.

Referring now to the drawings and in particular to FIG. 1, there is shown one embodiment of a bulky yarn producing apparatus in accordance with the present invention in which are provided first and second packages 1 and 1' on which are wound yarns Y and Y' comprising a thermoplastic fiber treated or semi-treated. The reference numerals 2 and 2' respectively indicate first and second guides, while the reference numerals 3 and 3' respectively designate first and second feed rollers. The reference numerals 4 and 4' respectively represent first and second heat plates which serve to heat the yarns Y and Y' which have passed through first and second guides 2 and 2', and first and second feed rollers 3 and 3' after being unwound from the first and second packages 1 and 1'. A first twist mechanism 5 is provided on a yarn travelling path of the yarn Y unwound from the package 1 and is shown particularly in FIG. 2 to comprise a twist unit 6 and a twist guide 7 provided at the upstream of the twist unit 6 along the yarn travelling path. The twist unit 6 comprises first, second and third rotary shafts **8*a*, 8*b* and 8*c* which are equi-spacedly arranged in parallel relation with each other and synchronizedly driven by an appropriate driving mechanism not shown. First, second and third friction discs 9*a*, 9*b* and 9*c* are secured to the first, second and third rotary shafts 8*a*, 8*b* and 8*c*, respectively, in such a manner that the first, second and third discs 9*a*, 9*b* and 9*c* are disposed in partly overlying and axially spaced relation with each other and extend in horizontal planes different from each other. The yarn Y runs downwardly while being brought into contact with the peripheries of the first, second and third friction discs 9*a*, 9*b* and 9*c* so that the yarn Y is twisted at the upstream of the first, second and third friction discs 9*a*, 9*b* and 9*c* while the yarn Y is untwisted at the downstream of the first, second and third friction discs 9*a*, 9*b* and 9*c*. A rubbing disc 11 is secured to a rotary shaft 10, which is securely connected with the first rotary shaft 8*a*, and is positioned on the yarn travelling path of the yarn Y which is twisted by the twist unit 6. In this instance, the yarn Y which is twisted is intended to indicate a yarn Y positioned at the upstream of the twist unit 6 and having a twist number over an effective twist number. The rubbing disc 11 is adapted to have a rough surface 11*a* on its periphery so that the yarn Y comes to be in frictional contact with the rough surace 11*a*, thereby imparting scratches to filaments constituting the yarn Y. The twist guide 7 is formed with a guide hole 12 at its forward end in order to guide the yarn Y to be brought into contact with the rough surface 11*a* of the rubbing disc 11 and the peripheries of the friction discs 9*a*, 9*b* and 9*c*. The foregoing rotary shaft 10 and the rubbing disc 11 constitute as a whole a rubbing mechanism generally indicated at 13**.

Figure 3:
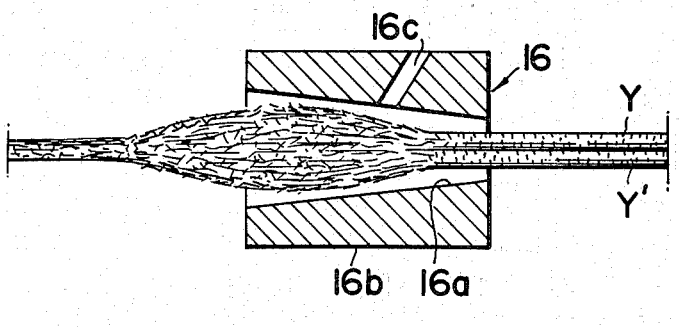
FIG. 3 is a cross-sectional view of an entangling device provided in the bulky yarn producing apparatus of the present invention.

Referring again to FIG. 1, the reference numeral 5' indicates an additional twist mechanism which is provided on an additional yarn travelling path of an additional yarn Y' unwound from the package 1' and which is constructed in substantially the same way as the twist mechanism 5. The reference numerals 14 and 14' respectively represent first and second delivery rollers, and the reference numeral 15 denotes a collecting guide which serves to collect the yarns Y and Y' unwound from the first and second packages 1 and 1'. At the downstream of the twist mechanisms 5 and 5' on the yarn travelling path of the yarns Y and Y' each of which is twisted is provided an entangling device 16 which functions to eject air around the speed of sound for diffusing, stretching and entangling the yarns Y and Y' to sever said filaments of the yarn Y at their scratches. The entangling device 16 is shown in FIG. 3 to comprises a block 16*b* having a diverged bore 16*a* to permit the yarns Y and Y' to pass therethrough, and at least one air nozzle 16*c* ejecting air around the speed of sound into the diverged bore 16*a* to revolve around the axis of the diverged bore 16*a*. The yarns Y and Y' are thus ejected and diffused and moved acceleratively so that the yarns Y and Y' are stretched and entangled and only the filaments of the yarn Y are severed at their scratches. The reference numeral 17 indicates a heat treating mechanism which is provided at the downstream of the entangling mechanism 16 on the yarn travelling path of the entangled yarns Y and Y' to have a heat plate 18 for heat-treating the yarns Y and Y'. A pair of first stretcher rollers 19 are provided at the downstream of the heat treating mechanism 17 on the yarn travelling path of the yarns Y and Y'. Further, a pair of second stretcher rollers 20 are provided at the downstream of the first stretcher rollers 19 and spaced apart from the first stretcher rollers 19 along the yarn travelling path to be rotated at a circumferential speed faster than that of the first stretcher rollers 19 for strechng the yarn Y and Y'. It is preferable that the circumferential speed difference between the first and second stretcher rollers 19 and 20 be about 30 percentages so as to sever the filaments of the yarn Y at their scratches. According to the present invention, the entangling device 16, the first stretcher rollers 19 and the second stretcher rollers 20 constitute as a whole a stretching mechanism generally indicated by the reference numeral 21. The reference numeral 22 represents a guide, and the reference numeral 23 denotes a winder for winding the yarns Y and Y'.

The operation of the apparatus thus constructed will be described hereinlater.

When the first and second feed rollers 3 and 3', the first and second delivery rollers 4 and 4', the first and second stretcher rollers 19 and 20, and the winder 23 is rotated, the yarns Y and Y' are respectively unwound from the first and second packages 1 and 1' and pass through the first and second feed rollers 3 and 3', the first and second heat plates 4 and 4', the first and second delivery rollers 14 and 14', the collecting guide 15, the entangling device 16, the heat plate 18, the first and second stretcher rollers 19 and 20, and the guide 22 to be wound by the winder 23. In addition, the first, second and third rotary shafts 8*a*, 8*b* and 8*c*, and the rotary shaft 10 is simultaneously rotated so that the first, second and third friction discs 9*a*, 9*b* and 9*c*, and the rubbing disc 11*a* are rotated. At this time, the yarn Y is twisted and untwisted by the twist unit 6 and runs while being rubbed by the rough surfaces of the rubbing disc 11, so that filaments forming the yarn Y are given scratches by the rubbing disc 11. On the other hand, the additional yarn Y is similarly unwound from the package 1' and twisted and untwisted by the second twist mechanism 5' with its filaments not scratched. The two yarns Y and Y' are then collected by the collecting guide 15 after passing through the first and second delivery rollers 14 and 14' to be fed to the entangling device 16. The twisted yarns Y and Y' are untwisted after passing through the twisting mechanisms 5 and 5'. The yarns Y and Y' are diffused and stretched by an ejecting air at the speed of sound from the air nozzle 16*a* of the entangling device 16 to entangle the yarns Y and Y' so that only the filaments of the yarn Y are severed at their scratches. The yarns Y and Y' are then travelled on the heat plate 18 to be heat treated thereby. As a heat shrinkage difference exists between the yarn Y having the filaments scratched and the yarn Y' having filaments not scratched, the entangling effect is preferably made. The yarns Y and Y' are then fed to the first and second stretcher rollers 19 and 20 where the yarns Y and Y' are temporarily stretched since the second stretcher roller 20 is rotated faster than the first stretcher roller 19 at a circumferential speed difference of about 30 percentages. As a consequence, there occur stresses at the remaining scratches of the filaments of the yarn Y where the filaments are severed, resulting in a number of fluffs on the surface of the yarn Y. Many fluffs are therefore made internally and externally of the yarns Y and Y', thereby causing a sufficiently fluffy feeling. The yarns Y and Y' are thereafter wound on the winder 23 after passing arund the guide 22.

In the previous embodiment, there has been described a friction disc type twist unit 6 used as a twist mechanism, but the following twist unit 27 may be used in place of the previous friction disc type twist unit 6.

Figure 2:
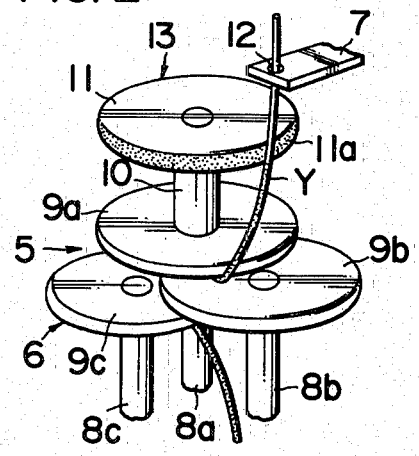
FIG. 2 is a perspective view of a twist mechanism and a rubbing mechanism provided in the bulky yarn producing apparatus of the present invention.
Figure 4:
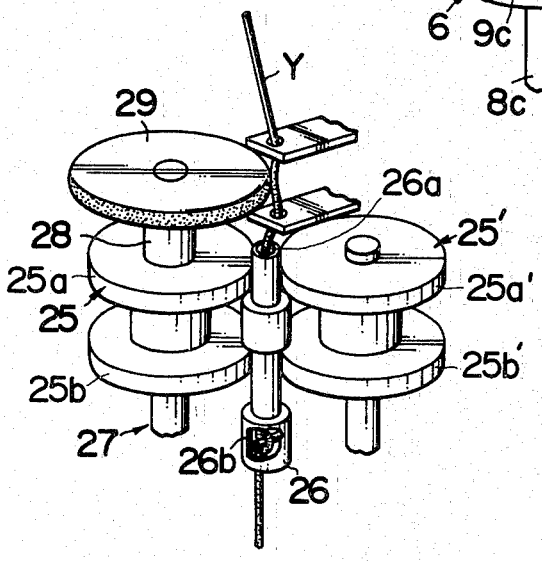
FIG. 4 is a view similar to FIG. 2 but showing another embodiment of the twist mechanism and the rubbing mechanism of the present invention.

With reference to FIG. 4, the twist unit 27 comprises two rotary shafts 28 and 28' arranged in parallel relation with each other, two friction disc members 25 and 25' respectively having friction disc portions 25*a*, 25*b*, 25*a*' and 25*b*' the former two of which are secured to the rotary shaft 28 and the latter two of which are secured to the rotary shaft 28', a cylindrical twist spindle 26 provided in frictional contact with the friction disc portions 25*a*, 25*b*, 25*a*' and 25*b*' and having an axial bore 26*a* and a peg 26*b* extending across the axial bore 26*a* to allow the yarn Y to be turned therearound for imparting the twist thereto. A rubbing disc 29 is secured to the rotary shaft 28 and formed with a rough surface on its periphery. It is also to be understood that the yarn Y is twisted by the false twist spindle 26 while the rubbing disc 29 imparting scratches to filaments constituting the yarn Y. According to the present invention, any one of the friction discs 9*a*, 9*b* and 9*c* may be formed with a rough surface without providing the rubbing disc 11 as shown in FIG. 2. In stead of the rubbing disc 11, a heat plate for heating the yarn may be used wherein the heat plate is required to have a rough surface in contact with the yarn Y. Further, a cooling plate for cooling the yarn Y may be used in lieu of the rubbing disc 11 wherein the cooling plate is also required to have a rough surface in contact with the yarn Y. The twist guide 7 may be intermittently moved to allow the yarn Y to be brought into contact with the rough surface of the rubbing disc 11 so that the scratches are intermittently imparted to the filaments of the yarn Y. Any yarns may be employed for the purpose of producing a bulky yarn in accordance with the present invention.

Accordingto the present invention, the filaments constituting the yarn is imparted scratches and then stretched so as to be severed at their scratches, thereby producing a sufficiently fluffy bulky yarn.

Although the particular embodiment of the present invention have been shown and described, it will be obvious to those skilled in the art that various changes and modifications may be made without departing from the spirit and scope of the present invention.

What is claimed is:

1. A bulky yarn producing apparatus comprising in combination:

a twisting zone along a yarn travelling path, a twist mechanism in said twisting zone for twisting and untwisting a yarn; a rubbing mechanism located in said twisting zone and having a rough surface so as to rub filaments of the yarn for imparting scratches thereto, said rubbing mechanism being disposed relative to said twist mechanism so as to rub the yarn while the yarn is in a twisted state, a stretching zone disposed along a portion of said yarn travelling path downstream of said twisting zone where the yarn is in an untwisted state, a stretching mechanism disposed in said stretching zone to stretch the yarn so that the filaments are severed at their scratches to produce a bulky yarn.

2. A bulky yarn producing apparatus as defined in claim 1, wherein said stretching mechanism comprises a pair of first stretcher rollers and a pair of second stretcher rollers provided downstream of said first stretcher rollers and spaced apart from said first stretcher rollers along said yarn travelling path to be rotated at a circumferential speed faster than that of said first stretcher rollers for stretching said yarn.

3. A bulky yarn producing apparatus as defined in claim 1, which further comprises an additional twist mechanism provided on an additional yarn travelling path for twisting and untwisting an additional yarn; and wherein said stretching mechanism comprises an entangling device collecting said untwisted yarns and having at least one air nozzle ejecting air for diffusing, stretching and entangling said yarns to sever said filaments at their scratches.

4. A bulky yarn producing apparatus as defined in claim 1, which further comprises an additional twist mechanism provided on an additional yarn travelling path for twisting and untwisting an additional yarn; and wherein said stretching mechanism comprises an entangling device collecting and entangling said yarns, a pair of first stretcher rollers provided at the downstream of said entangling device and spaced apart from said entangling device along said yarn travelling path, and a pair of second stretcher rollers provided at the downstream of said first stretcher rollers and spaced apart from said first stretcher rollers along said yarn travelling path to be rotated at a circumferential speed faster than that of said first stretcher rollers for stretching said yarns and severing said filaments at their scratches.

5. A bulky yarn producing apparatus as defined in claim 1, which further comprises an additional twist mechanism provided on an additional yarn travelling path for twisting and untwisting an additional yarn; and wherein said stretching mechanism comprises an entangling device collecting said yarns and having at least one air nozzle ejecting air for diffusing, stretching and severing said yarns at their scratches, a pair of first stretcher rollers provided at the downstream of said entangling device and spaced apart from said entangling device along said yarn travelling path and a pair of second stretcher rollers provided at the downstream of said first stretcher rollers and spaced from said first stretcher rollers along said yarn travelling path to be rotated at a circumferential speed faster than that of said first stretcher rollers for stretching said filaments at their scratches.

6. A bulky yarn producing apparatus comprising in combination:

a twist mechanism provided on a yarn travelling a path for twisting and untwisting a yarn;

a rubbing mechanism provided on said yarn travelling path of said yarn which is twisted by said twist mechanism and having a rough surface so as to rub filaments constituting said yarn for imparting scratches thereto; and a stretching mechanism provided on the downstream of said rubbing mechanism along said yarn travelling path of said untwisted yarn to stretch said yarn so that said filaments are severed at their scratches to produce a bulky yarn;

said twist mechanism comprising three rotary shafts equi-spacedly arranged in parallel relation with each other and three friction discs each secured to each of said rotary shafts in such a manner that said friction discs are disposed in partly overlying and axially spaced relation with each other and extend in parallel planes different from each other; said rubbing mechanism comprising a rubbing disc secured to one of said rotary shafts to be disposed above said friction rollers and formed with said rough surface on its periphery.

7. A bulky yarn producing apparatus, comprising in combination:

a twist mechanism provided on a yarn travelling path for twisting and untwisting a yarn;

a rubbing mechanism provided on said yarn travelling path of said yarn which is twisted by said twist mechanism and having a rough surface so as to rub filaments constituting said yarn for imparting scratches thereto; and a stretching mechanism provided on the downstream of said rubbing mechanism along said yarn travelling path of said untwisted yarn to stretch said yarn so that said filaments are severed at their scratches to produce a bulky yarn;

said twist mechanism comprising two rotary shafts arranged in parallel relation with each other, two friction discs each secured to each of said rotary shafts, and a cylindrical twist spindle having an axial bore and a peg extending across said axial bore to allow said yarn to be turned therearound for imparting the twist and untwist thereto; said rubbing mechanism comprising a rubbing disc secured to one of said rotary shafts to be disposed above said friction discs and formed with said rough surface on its periphery.

* * * * *